US005759082A

United States Patent [19]

Kujawski et al.

[11] Patent Number: 5,759,082

[45] Date of Patent: Jun. 2, 1998

[54] CARTWHEEL TUMBLING DOLL

[75] Inventors: Brian S. Kujawski, Crown Point, Ind.; Timothy Carroll, Chicago; Donald A. Rosenwinkel, Oak Park, both of Ill.

[73] Assignee: Breslow, Morrison, Terzian & Associates, LLC, Chicago, Ill.

[21] Appl. No.: 798,427

[22] Filed: Feb. 7, 1997

[51] Int. Cl.[6] ..... A63H 11/08

[52] U.S. Cl. ..... 446/139; 446/324

[58] Field of Search ..... 446/324–326, 446/137–139, 396, 308, 309, 311, 312

[56] References Cited

U.S. PATENT DOCUMENTS 2,021,588 11/1935 Baker ..... 446/324

4,530,672 7/1985 Yoneda ..... 446/324

*Primary Examiner*—Mickey Yu

*Attorney, Agent, or Firm*—Dick and Harris

[57] ABSTRACT

A cartwheel tumbling doll has a torso and a head mounted on the torso. An axis extends generally through the center of the head and torso. A pair of arms, each arm having a shoulder end and a hand end, are mounted for limited pivotal movement adjacent each arm's shoulder about a respective axis that is generally perpendicular to the center axis. A pair of legs, each leg having a hip end and a foot end, are mounted adjacent each leg's hip for limited pivotal movement relative to the torso about a respective axis that is generally perpendicular to the center axis. A weight is releasably connected to each hand. The foot of each leg contacts a substantially planar surface to support the doll in a generally upright position with the arms extended away from the feet and carrying the releasably connected weights. Pushing one side of the doll causes it to tumble sideways or cartwheel. When each weight contacts the surface, a release mechanism releases each weight from its respective hand permitting the doll to continue to cartwheel until the feet again contact the surface and the doll is in the generally upright position.

20 Claims, 4 Drawing Sheets

CARTWHEEL TUMBLING DOLL

BACKGROUND OF THE INVENTION

1. Field of the Invention

This invention relates generally to dolls having mechanisms for simulating gymnastic type action such as tumbling and more particularly relates to a mechanism for a tumbling doll that can tumble sideways or cartwheel.

2. Background Art

Dolls capable of simulating various human activities have long been popular playthings. Thus, dolls that simulate crying, eating, walking and other actions, including tumbling, have long been popular playthings. There have been a number of prior art dolls that perform gymnastic activities such as tumbling, as for example the Tumbles Surprise doll by Toy Biz, Inc. Nevertheless, there remains a need for a doll that effectively simulates a tumbling action such as cartwheels.

SUMMARY OF THE INVENTION

The present invention is concerned with providing a cartwheel tumbling doll comprising a torso with a head mounted on the torso along an axis extending generally through the center of the head and torso. Each of a pair of arms has a shoulder end and a hand end, and each of the arms is mounted for limited pivotal movement adjacent its shoulder end about a respective axis that is generally perpendicular to the axis extending generally through the center of the head and torso. Each of a pair of legs has a hip end and a foot end, and each leg is mounted adjacent its hip end for limited pivotal movement relative to the torso about a respective axis that is generally perpendicular to the axis extending generally through the center of the head and torso. A weight is releasably connected to each hand end. The foot end of each leg contacts a substantially planar surface to support the doll in a generally upright position with the arms extended away from the foot ends and carrying the releasably connected weights. A push to one side of the doll will cause it to tumble to the opposite side, or cartwheel, bringing the weights into contact with the substantially planar surface. A release mechanism releases each weight from its respective hand end upon the weight contacting the substantially planar surface so that the doll continues to cartwheel until the foot ends again contact the surface with the doll in the generally upright position.

BRIEF DESCRIPTION OF THE DRAWINGS

For a better understanding of the present invention, reference may be had to the accompanying drawings in which.

DETAILED DESCRIPTION

Figure 1A:
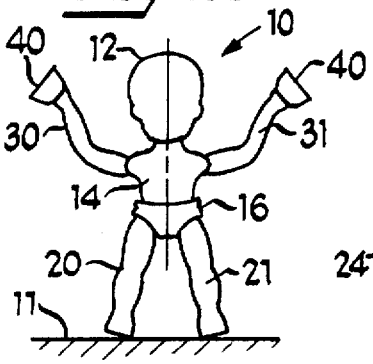
FIGS. 1A through 1G schematically illustrate a cartwheel performed by an embodiment of the present invention.

Referring now to the drawings in which like parts are designated by like reference numerals throughout the several views, there is shown in FIGS. 1A through 1G a doll 10 performing a cartwheel upon a substantially planar surface 11 such as a table top or floor. Doll 10 has a head 12 connected to an upper torso 14 which in turn is connected to a lower torso 16. Extending generally through the center of the head and torso is an axis 18, which is generally vertically disposed in FIG. 1A.

Doll 10 also includes a right leg 20 and a left leg 21, each having respectively hip ends 22 and 23 and foot ends 24 and 25. The bottom of each foot end 24, 25 is conveniently provided with a covering of a friction enhancing material 26, such as rubber. Each of legs 20 and 21 are connected at their respective hip ends 22, 23 to lower torso 16 for limited pivotal movement with respect to lower torso 16. Doll 10 also has a right arm 30 and a left arm 31 with each of the arms having a respective shoulder end 32, 33 and a respective hand end 34, 35. Releasably connected to each of the respective hand ends is a weight 40. With doll 10 costumed as a cheerleader, weights 40 are conveniently styled as pom pons.

Figure 2:
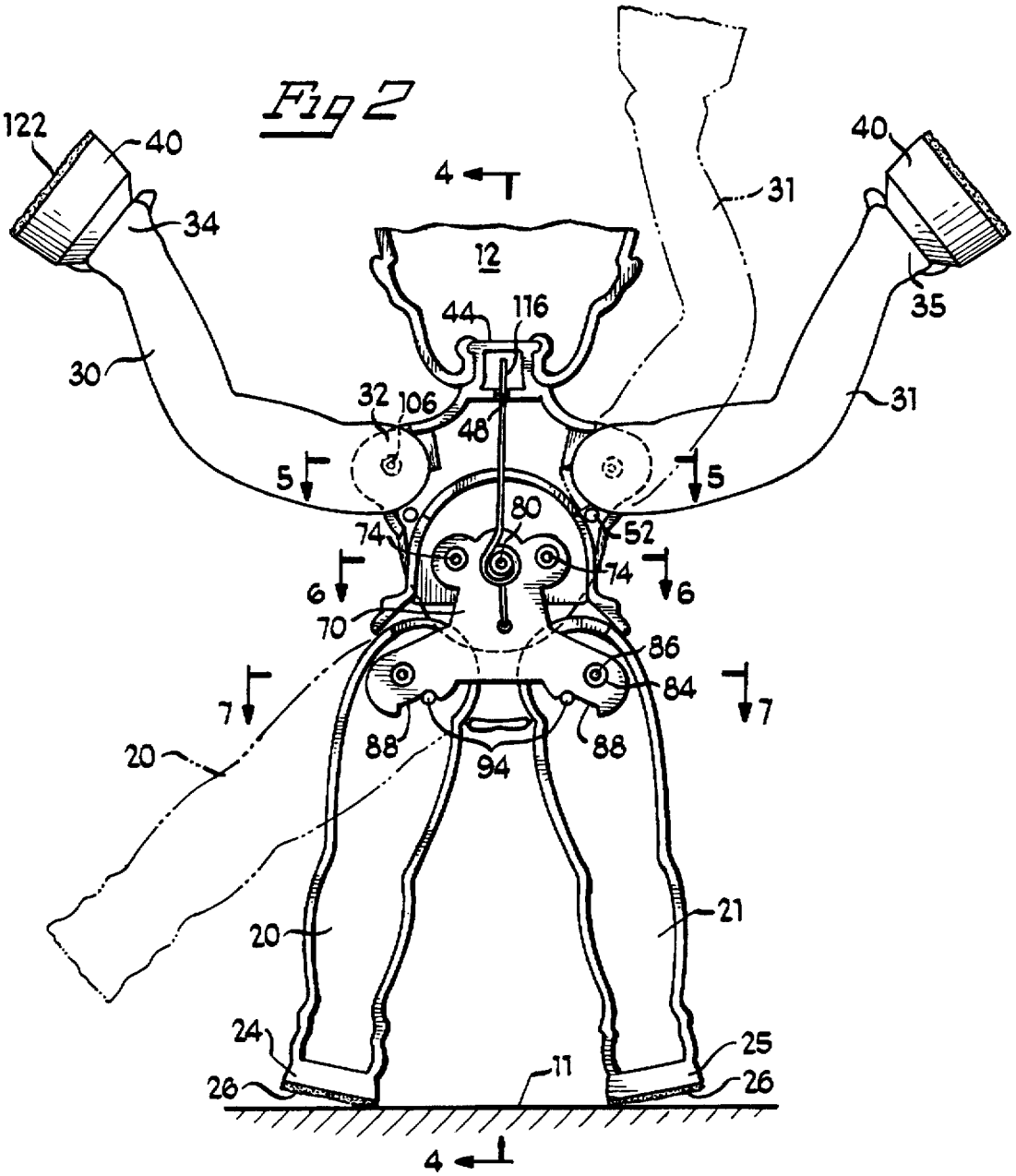
FIG. 2 is an enlarged scale elevation, partially in section along a generally front to back vertical plane extending through the head, torso and legs of the doll schematically shown in FIGS. 1A–1G.
Figure 5:
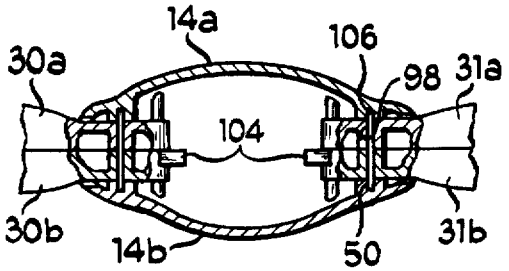
FIG. 5 is a sectional view taken generally along Line 5—5 of FIG. 2.
Figure 6:
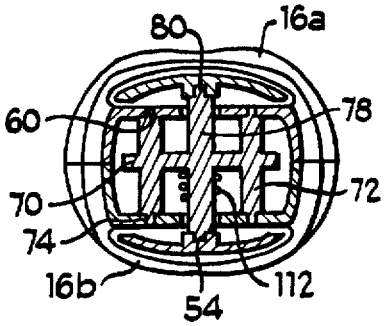
FIG. 6 is a sectional view taken generally along Line 6—6 of FIG. 2.
Figure 3:
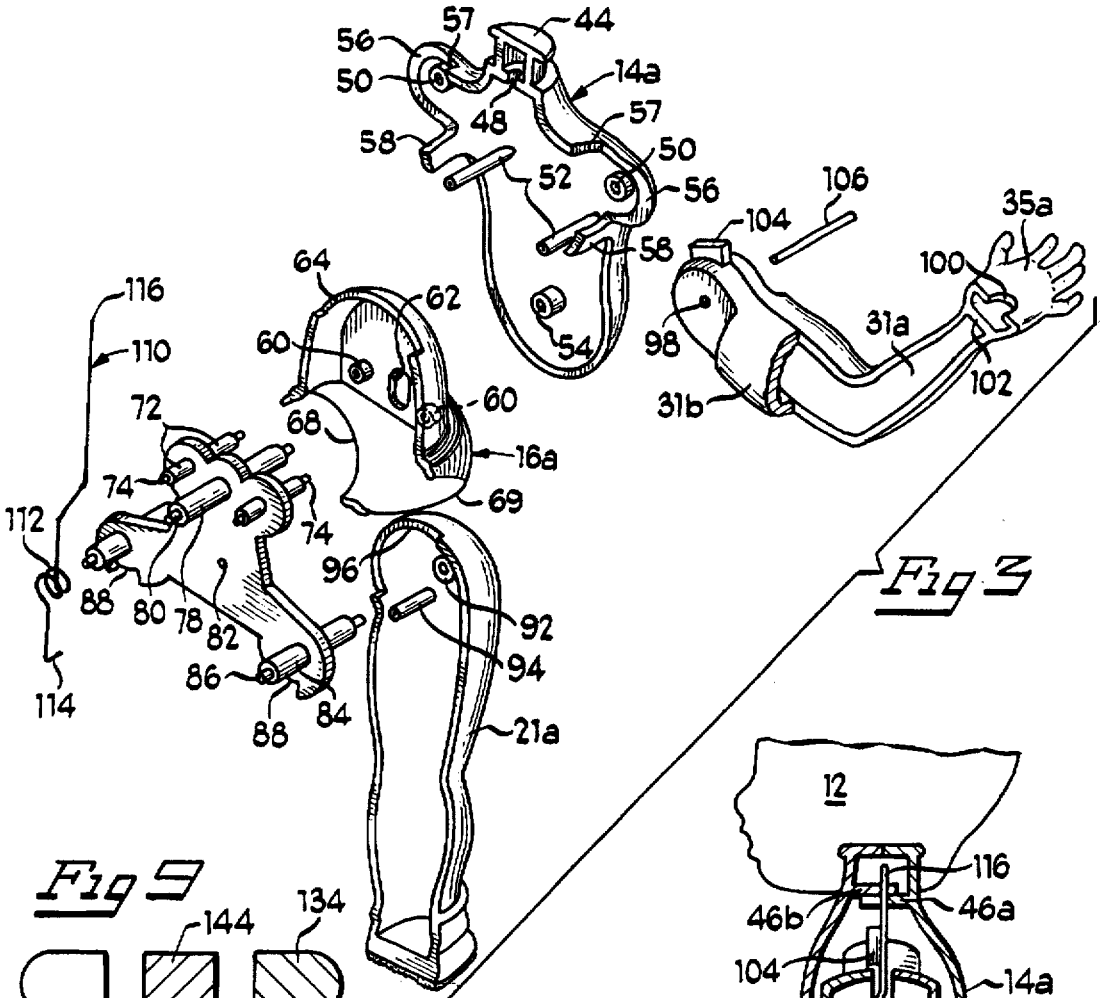
FIG. 3 is a fragmentary, exploded perspective view of some of the components shown in FIG. 2.

As is best shown in FIGS. 2–7, the various parts of doll 10 are generally hollow and are formed of mating shell portions in a manner that is conventional in the manufacture of dolls. Thus, the upper torso is made up of a rear shell **14*a* and front shell 14*b*. Similarly, the lower torso has a rear shell 16*a* and a front shell 16*b*. Left leg 21 is made up of a rear shell 21*a* and a front shell 21*b*. FIG. 3 illustrates rear shell 33*a* of the left arm plus a portion of front shell 33*b***. The right leg and right arm are similarly made up of mating shells in the conventional manner.

Figure 4:
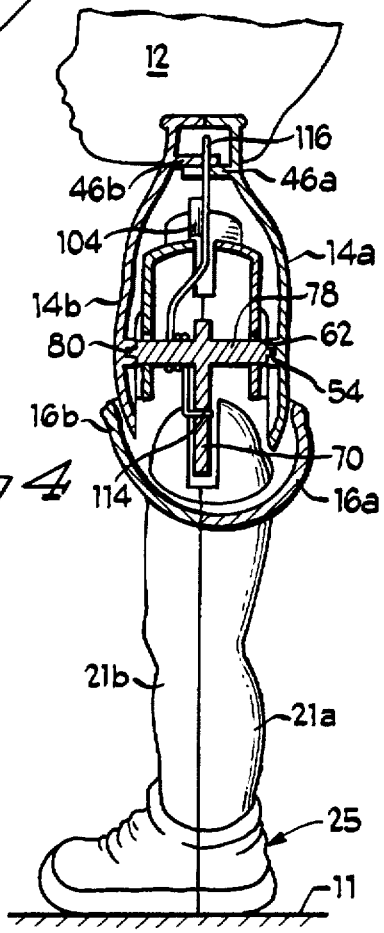
FIG. 4 is a sectional view taken generally along Line 4—4 of FIG. 2.

Upper torso 14 includes a neck portion 44 upon which head 12 is mounted, as is best shown in FIGS. 2 and 4. Lower flanges **46*a* and 46*b* of neck portion 44 define an aperture 48. Extending forwardly from rear upper torso shell 14*a*, adjacent each shoulder, is an arm mounting boss 50. Similar, cooperating apertured mounting bosses (not shown) extend rearwardly from front shell 14*b*. A pair of mounting posts 52 extend forwardly from rear shell 14*a* and cooperate in a conventional manner with mounting pins (not shown) extending rearwardly from front shell 14*b*. Also extending forwardly from rear upper torso shell 14*a* is a center apertured mounting boss 54 which cooperates with a rearwardly extending apertured mounting boss 54 on front upper torso shell 14*b*. Outboard of each of arm mounting bosses 50 is a cut-out arm portion 56 having an upper shoulder end 57 and a lower side end 58. Front upper torso shell 14*b* cooperates with rear shell 14*a*** to define a complete arm opening.

Lower rear torso shell **16*a* has a pair spaced apart apertured mounting bosses 60 extending forwardly. Front lower torso shell 16*b* has a similar, cooperating pair of apertured mounting bosses (not shown) that extend rearwardly from the front lower torso shell. Disposed between mounting bosses 60, in each of lower torso rear and front shells 16***a* and 16*b* is an elongated aperture 62. As is perhaps best illustrated in FIGS. 3 and 4, the upwardly extending portion of the lower torso is of a reduced cross-section so as to readily fit within the hollow interior of the upper torso formed by rear shell 14*a* and front shell 14*b*. Each of rear shell 16*a* and front shell 16*b* have an arcuate cut-out portion 64 adjacent the top. At the lower end of lower torso 16, hip cut-outs 68, 69 are formed by the cooperating rear and front shells 16*a* and 16*b*.

Within assembled upper torso shells 14*a*, 14*b* and lower torso shells 16*a*, 16*b* is a mounting plate 70 which is generally centrally disposed between the front and back of the torso, as is best illustrated in FIG. 4. Projecting fore and aft of mounting plate 70 are a pair of spaced apart posts 72 each having a reduced diameter pin end 74. Each of pin ends 74 is received in a respective apertured boss 60 by a press or interference fit to secure mounting plate 70 within lower torso 16. Cut-out portions 64 adjacent the top of lower torso shells 16*a* and 16*b* accommodate the upper extension of mounting plate 70 into upper torso 14. Also extending fore and aft of mounting plate 70, adjacent its upper end, are posts 78 which have reduced diameter pin ends 80. Posts 78 extend through the respective apertures 62 in the rear and front lower torso shells 16*a*, 16*b* with pin ends 80 being received in apertured mounting bosses 54 on the upper torso rear and front shells 14*a*, 14*b*. Pins 80 are sized to be received in apertured bosses 54 so as to permit some rotation of the apertured bosses about the pins and hence some rotation or pivoting of upper torso 14 relative to lower torso 16 and mounting plate 70. Disposed approximately in the center of mounting plate 70 is an aperture 82. Mounting plate 70 additionally has fore and aft extending posts 84 adjacent the lower sides of the mounting plate. Each of posts 84 have a reduced pin end 86. In the lower edge of mounting plate 70, generally below each of posts 84 is a notch 88.

Left leg rear shell 21*a* is formed with a forwardly projecting apertured boss 92 adjacent the upper hip end. Disposed below and inboard of apertured mounting boss 92 is a forwardly projecting stop pin 94. Along the upper inside hip end of shell 21*a* is an arcuate cut-out portion 96. Front shell 21*b* of the left leg has a similar apertured mounting boss 92 that projects rearwardly and also has a similar cut-out portion 96. A pin (not shown) may extend rearwardly from front shell 21*b* to cooperate with post 94 to help secure shells 21*a* and 21*b*. In addition, an adhesive or ultrasonic welding may also be used to help secure the rear and front shells together. Right leg 20 is constructed in a manner similar to left leg 21 and need not be illustrated nor described in detail as such would be redundant, particularly to those skilled in the art.

Each of pin ends 86 is received in a respective apertured boss 92 to mount each of the legs for limited pivotal movement with respect to plate 70 and lower torso 16. Accordingly, pin ends 86 are sized so as to be received in apertured bosses 92 for relative pivotal movement of the pins with respect to the apertured bosses. Limits on the pivotal movement of each leg with respect to mounting plate 70 results from each respective pin 94 abutting the opposed ends of notch 88 when a leg is at either end of its limited pivotal movement. FIG. 2 illustrates each of legs 20 and 21 at their inward limit of pivotal movement with pin 94 abutting the inside end of notch 84. Also shown in phantom line is right leg 20 at its limit of outward movement in which pin 94 would abut the outside end of notch 84.

Rear shell 31*a* of left arm 31 is formed with an aperture 98 extending through its shoulder end 33. At hand end 35, shell 31*a* is formed with the forward or finger portion of a left hand 35*a*. In the palm of the left hand is an aperture 100 formed at least in part in shell 35*a*. Inward of aperture 100, each hand portion has an integrally formed wall 102 with an aperture 103 in general alignment with aperture 100. Front shell 31*b* is formed with a similar aperture 98 that aligns with the aperture in the shoulder end of rear shell 31*a*. Projecting upwardly from the shoulder end of front shell 31*b* is a tab 104. Front shell 31*b* also has the rearward or heel end of the left hand which mates with finger portion 35*a* and completes aperture 100. Each arm is mounted for pivotal movement with respect to upper torso 14 by a pin 106 which extends through aperture 98 and is received in cooperating aperture bosses 50 on each of the rear and front upper torso shells 14*a* and 14*b*, respectively. Pin 106 may be rotationally received either in apertures 98 or in apertured bosses 50. The pivotal movement of each arm with respect to upper torso 14 is limited by the abutment of tab 104 with either the upper end 57 of arm opening 56 or the lower side end 58 of the arm opening.

A spring 110, or more particularly a coiled portion 112 of the spring is fitted over post 78 that projects toward front shell 14*b*. A lower bent end 114 of the spring is anchored in aperture 82 of plate 70. An upper portion 116 of the spring extends through aperture 48 and anchors the upper end of spring 110 with respect to upper torso 14. Thus, spring 110 biases upper torso 14 to a generally vertically aligned or upright position with respect to mounting plate 70 and lower torso 16.

Each of weights 40, which are shown in greater detail in FIGS. 8A through 8C and FIG. 9, has a free end 120 to which may be conveniently applied a friction enhancing material 122, such as rubber. Opposite free end 120 is a releasably connected end 124. Generally centrally disposed in each weight 40 is a bore 126 that extends from connected end 124 through the weight to free end 120. A circular aperture 128, that is coaxial and communicates with bore 126 extends through free end 122. Aperture 128 is of a smaller diameter than bore 126. An elongated, hollow releasable connector 130 is fitted into bore 126 and the lower portion of connector 130 is secured within bore 126 by a press or interference fit, adhesive, ultrasonic welding or other type of securement commonly used in doll manufacturing. The upper portion 132 of releasable connector 130 is generally conical or otherwise tapered from approximately its midportion toward its upper connected end. Immediately adjacent the upper or connected end of releasable connector 130 is a outwardly extending rim 134. Inboard or below rim 134 and spaced from rim 134 is a constricted, reduced diameter portion defined by an inwardly annular flange 136. Releasable connector 130 is made of a resilient material and conical portion 132 is preferably slotted or bifurcated to facilitate radial expansion and contraction of the upper rim end. Although, as illustrated in section in FIGS. 8A through 8C and FIG. 9, only one slot 138 is shown, it will be apparent to those skilled in the art that depending upon the inherent properties of the material used for releasable connector 130, additional slots may be provided to enhance its flexibility.

Received within releasable connector 130 is an elongated plunger 140. A free end 142 of plunger 140 is sized to readily fit and move within aperture 128. Opposite end 142 is end 144. Plunger 140 is longer than the thickness of weight 40 so that either free end 142 extends beyond the outer surface of free end 122 of weight 40 or end 144 extends beyond connected end 124 of weight 40 into aperture 103. A radially enlarged body portion 146 of plunger 140 within releasable connector 130 serves to limit the axial movement of plunger 140. Adjacent end 144 and disposed below or inward of end 144 is a radially extending flange 148. Flange 148 is sized so as to outwardly bias or expand rim end 134 of releasable connector 130 when flange 148 is positioned within the constructed portion of inwardly extending flange 136 of releasable connector 130.

Figure 9:
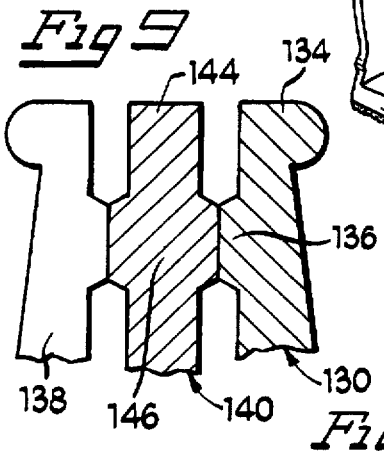
FIG. 9 is an enlarged scale sectional view of a part of the releasable weight connection mechanism.
Figure 7:
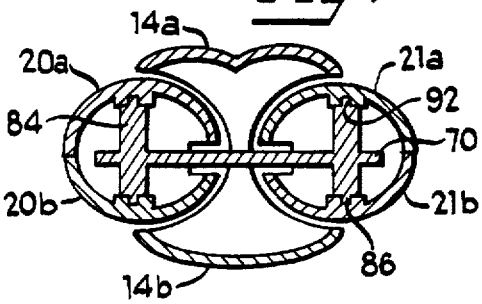
FIG. 7 is a sectional view taken generally along Line 7—7 of FIG. 2.

When the bottom of body portion 146 abuts the inside of free end 120 of weight 40, end 142 projects outwardly beyond the outside of free end 120 and flange 148 is disposed within inwardly directed flange 136 of releasable connector 130. The outside diameter of flange 148 is larger than the inside diameter of flange 136 while still being small enough that it can be forced into the constructed portion defined by flange 136 and spread it apart. The difference in the size of the diameters may be of a magnitude of 0.025 inches. In addition, as is best shown in FIG. 9, the leading and trailing edges of both flange 136 and flange 148 are tapered to facilitate fitting flange 148 into the constricted portion or opening defined by flange 136. When flange 148 is positioned in the opening defined by flange 136, upper conical portion 132, and in particular rim 134, are expanded outwardly.

Figure 8A:
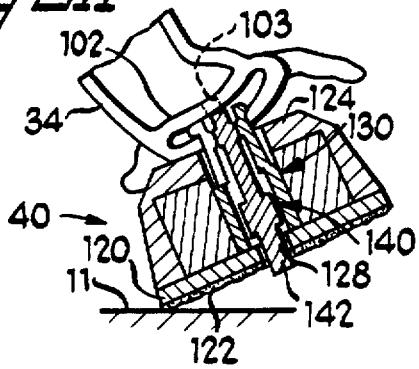
FIGS. 8A through 8C are enlarged scale, fragmentary sectional views of the right band end of the doll illustrated in FIGS. 1A through 1G and the releasably connected weight.
Figure 8B:
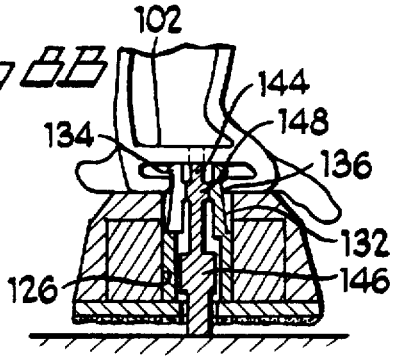
Figure 8C:
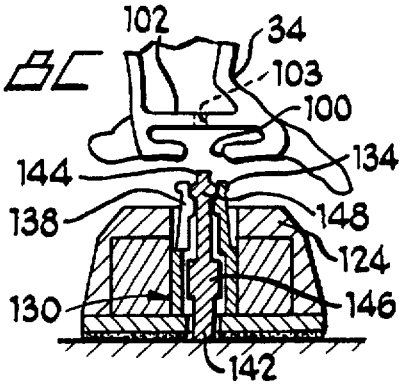

The relationship between the diameters of the upper portion of releasable connector 130 and aperture 100 in the palm of either hand end of the doll are such that, when the upper portion of releasable connector 130 is not expanded, it readily fits into and out of aperture 100. However, when the upper portion of releasable connector 130 is expanded by flange 148 being positioned with the opening defined by flange 136, the upper portion of releasable connector 130, and in particular rim 134, is so expanded as to be retained within aperture 100 and appear to be held by the hand of the doll. When, as is best illustrated in FIGS. 8B and 8C, free end 120 of weight 40 comes into contact with substantially planar surface 11, free end 142 of plunger 140 is pushed inwardly and flange 148 is dislodged upwardly from the opening defined by flange 136 with end 144 entering aperture 103. Upon flange 148 being dislodged from the opening defined by flange 136, the upper portion of resilient releasable connector 130, more particularly rim 134, contracts or returns to its unbiased size which permits it to readily pass through aperture 100 and be released from the hand of the doll.

Figure 1B:
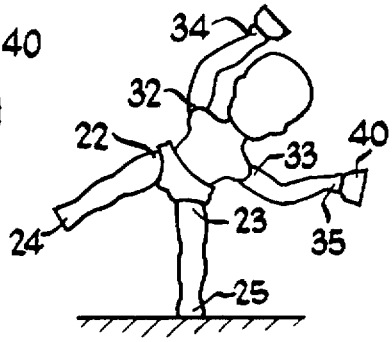
Figure 1C:
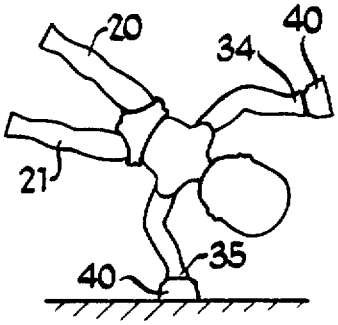
Figure 1D:
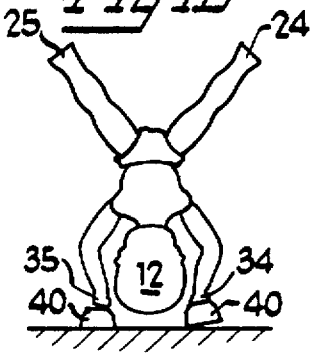

With doll 10 in the position illustrated in FIG. 1A and the arms and legs connected to the torso for pivotal movement about axes that are all perpendicular to axis 18 while being in planes substantially parallel to the other pivotal axes of the hands and legs, doll 10 can be made to tumble sideways or cartwheel merely by a child exerting a slight force on the right side of the doll causing the doll to tilt to the right as illustrated in FIGS. 1A through 1G. Once doll 10 is pushed off center, weight 40 releasably connected to left hand 35 pivots the doll about the doll's left foot 25 to begin to rotate clockwise (to the doll's left—the right side of the sheet containing FIGS. 1A through 1G). This brings weight 40 releasably connected to the doll's right hand 34 slightly over center, or past the twelve o'clock position, and beyond the contact of left foot 25 with planar surface 11 in approximately the six o'clock position as illustrated in FIG. 1B. Doll 10 then continues as illustrated in FIG. 1C to tip over with weight 40 releasably connected to hand 35 next coming into contact with surface 11, bringing head 12 and weight 40 releasably connected to right hand 34 to about the three o'clock position. At the same time, legs 20 and 21 continue to pivot upwardly to about the nine and ten o'clock positions. As shown in FIG. 1D, there comes a point in time when weight 40 carried by left hand 35 is in contact with planar surface 11 and weight 40 carried by right hand 34 is almost in contact with surface 11. At this time, each of arms 30 and 31 are at the upper or inner limit of their pivotal movement with each tab 104 abutting lower side portion 58 of respective arm opening 56.

Figure 1E:
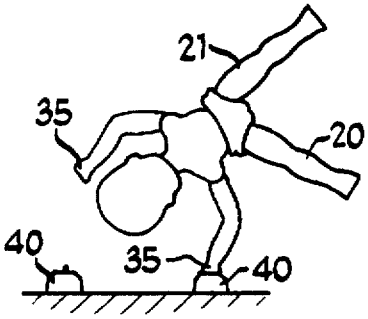
Figure 1F:
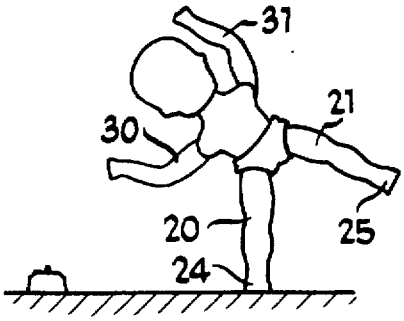
Figure 1G:
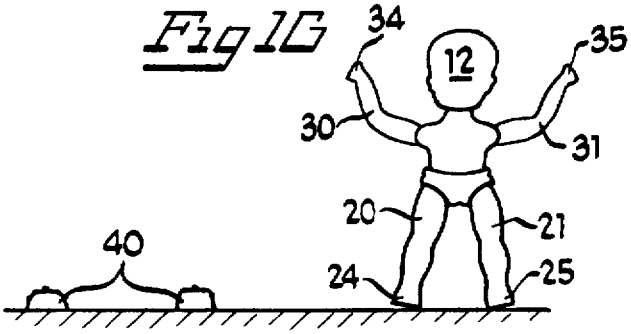

As was previously described, when weight 40 is brought into contact with substantially planar surface 11, plunger 140 will be pushed upwardly effecting release of connector 130 from the hand of the doll. Thus, as is illustrated in FIG. 1E, weight 40 is released from left hand 35 and remains behind on surface 11 as doll 10 continues to rotate in a clockwise manner with legs 20 and 21 now being in the four o'clock and one o'clock position, respectively, and arm 30 being generally in the six o'clock position with weight 40 releasably connected to hand 34 being brought into contact with surface 11. Again, upon free end 120 of weight 40 being brought into contact with surface 11, plunger 140 will be moved upwardly releasing the weight from the hand and doll 10 will continue to pivot clockwise. As illustrated in FIG. 1F, right leg 20 will then be brought into contact with planar surface 11 in substantially the six o'clock position. Left leg 21 will then be at about the four o'clock position, arm 31 in the eleven o'clock position and arm 30 in the nine o'clock position. Doll 10, with both released weights 40 remaining behind as illustrated in FIG. 1G, will then in the absence of any further momentum by weights 40 leave right leg 20 remain in contact with surface 11 and also bring left leg 21 into contact with surface 11. Spring 110 will then exert a biasing force to return head 12, upper torso 14 and lower torso 16 to a generally upright vertical position. Doll 10 will have thus completed its cartwheel and returned back to its original position, but without weights 40.

In order to have doll 10 perform an additional cartwheel, each of weights 40 are again releasably connected to a respective hand 34 and 35. Each of weights 40 are first inverted and pressed against surface 11 to reseat plunger 140 with flange 148 positioned in the opening defined by flange 136. Expanded releasable connector 130 may then be forced into aperture 100 for releasable connection with end 144 of plunger 140 reinserted into aperture 100., Each of hands 34 and 35 are made of a material that is sufficiently resilient, such that even in its expanded position rim 134 may be forced through aperture 100 to releasably connect weight 40 to a hand.

Figure 10A:
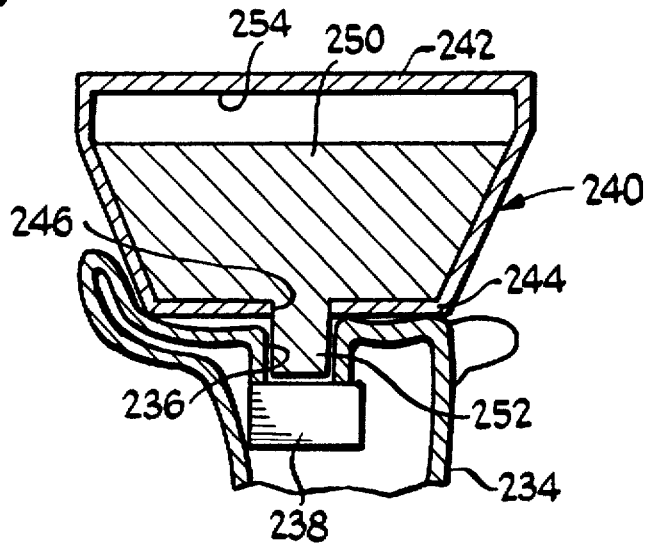
FIG. 10A and 10B are enlarged scale, fragmentary sectional views of a modified right hand end of the doll with an alternate releasably magnetically connected weight.
Figure 10B:
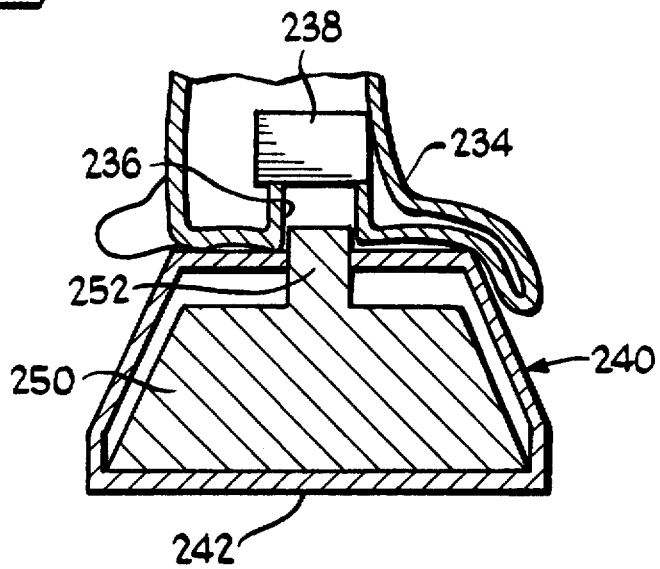

An alternate, releasable magnetic connector mechanism is illustrated in FIGS. 10A and 10B. Hand 234 includes a socket 236 in the palm of the hand. Adjacent the inside end of socket 236, within the hollow interior of hand 234 is a magnet 238 secured by adhesives or the like. Weight 240 has a free end 242 and a connected end 244, which is received in the palm of hand 234. An aperture 246 in the connected end 244 of weight 240 aligns with socket 236 when weight 240 is positioned in the palm of hand 234. Carried within weight 240 for reciprocating movement between free end 242 and connected end 244, is a ferrous mass 250 that may magnetically engage magnet 238. Ferrous mass 250 may conveniently be made in the form of a truncated cone. Extending outwardly from the truncated top of the cone is a stem 252 which is received through aperture 246 into socket 236, and into magnetic engagement with magnet 238 when ferrous mass 250 is in the position illustrated in FIG. 10A adjacent connected end 244. With ferrous mass 250 in the position illustrated in FIG. 10A there is an empty space 254 between free end 242 of weight 240 and the end of ferrous mass 250 that is opposite stem 252.

When hand 234 with the releasably connected weight is inverted to the position illustrated in FIG. 10B and brought into contact with surface 11 as would occur in FIGS. 1C, 1D and 1E, the momentum of weight housing 240 being brought into contact with surface 11, together with gravity, causes ferrous mass 250 to drop into space 254 disengaging the magnetic connection between magnet 238 and stem 252. With the alternative releasable magnetic connection, right and left hands 34 and 35 may be provided with connections of different strength. Thus, by positioning magnet 238 a somewhat greater distance from stem 252 in one hand than in the other hand, release will be more readily effected in the hand in which the magnet is spaced a greater distance from stem 252.

While doll 10 has been illustrated and described in an embodiment facilitating the performance of a sideways tumble or cartwheel, it will be readily appreciated by those skilled in the art that the invention may be readily used in another embodiment in which a doll, or other character, performs a front-to-back tumble. In such an alternative embodiment, the pins or posts providing axes for the pivotal movement of the arms and legs would be rotated 90 degrees so that they will all lie substantially in the same plane and be perpendicular to axis 18. Appropriate modifications will of course have to made in the various apertured mounting bosses and openings for the legs and arms previously described to accommodate the reorientation of the pivotal axes. However, in view of the illustrations and detailed description of the one embodiment, and such changes should be readily apparent to those skilled in the art.

While a particular embodiment of the present invention has been shown and described in detail, and alternative embodiments has also been described, it will be apparent that further alternatives, changes and modifications will occur to those skilled in the art. It is intended in the appended claims to cover all such changes and modifications as fall within the true spirit and scope of the present invention.

What is claimed as new and desired to be secured by Letters Patent is:

1. A doll comprising:

a torso;

a head mounted on the torso;

an axis extending generally through the center of the head and torso;

a pair of arms;

each arm having a shoulder end and a hand end;

each of the arms being mounted for limited pivotal movement adjacent its shoulder end about a respective axis that is generally perpendicular to the axis extending generally through the center of the head and torso;

a pair of legs;

each leg having a hip end and a foot end;

each of the legs being mounted adjacent its hip end for limited pivotal movement relative to the torso about a respective axis that is generally perpendicular to the axis extending generally through the center of the head and torso;

a weight releasably connected to each hand end;

the foot end of each leg is adapted to contact a substantially planar surface to support the doll in a generally upright position with the arms extended away from the foot ends and carrying the releasably connected weights; and a release mechanism for releasing each weight from its respective hand end upon the weight contacting the substantially planar surface.

2. The doll of claim 1 including a spring mounted within the torso to bias the torso into a generally upright position when the foot ends are in contact with the substantially planar surface.

3. The doll of claim 1 in which the torso includes:

an upper torso; and a lower torso connected together for relative pivotal movement.

4. The doll of claim 3 including a spring mounted within the torso to bias the torso into a generally upright position when the foot ends are in contact with the substantially planar surface.

5. The doll of claim 4 in which the spring is elongated and has opposed ends with one end being anchored relative to the lower torso and the other end being anchored relative to the upper torso.

6. The doll of claim 3 including a mounting plate secured to one of the upper torso or lower torso and connected for relative pivotal movement to the other of the upper torso or lower torso.

7. The doll of claim 6 in which the mounting plate includes stops for limiting the pivotal movement of the legs.

8. The doll of claim 6 in which portions of the mounting plate fit into each of the legs and provide mounts for pivotal movement of the legs relative to the mounting plate.

9. The doll of claim 8 including:

a notch in an edge of each portion of the mounting plate fitting into each leg; and each leg having a pin that cooperates with the notch to define the limits of the pivotal movement of the leg.

10. The doll of claim 6 in which:

an elongated spring is mounted within the torso to bias the torso into a generally upright position when the foot ends are in contact with the substantially planar surface;

the elongated spring has opposed ends;

one end of the spring is received in an aperture in the mounting plate to anchor it with respect to one of the upper or lower torso; and the other end is anchored to the other end of the upper torso or lower torso.

11. The doll of claim 3 in which:

the upper torso has openings to receive the arms for limited pivotal movement;

the openings each have upper and lower ends; and a portion of each arm abuts the upper and lower ends of the opening that receives the arm to limit the pivotal movement.

12. The doll of claim 1 in which:

the weight has a connected end and a free end; and a connector extends from the connected end to cooperate with the hand end of an arm to releasably connect the weight to the hand.

13. The doll of claim 12 in which:

the connector is elongated and hollow with an expandable connecting end;

the hand end of each arm has an aperture that receives the expandable connecting end; and a moveable piece is carried within the elongated hollow connector to expand the connecting end.

14. The doll of claim 13 in which the moveable piece is an elongated plunger that projects outwardly beyond the free end of the weight in the expandable connecting end expanding position.

15. The doll of claim 13 in which:

the connector has a constricted portion; and the moveable piece has an expanded portion which may be forced into the constricted portion to expand the expandable connecting end.

16. The doll of claim 15 in which the moveable piece is an elongated plunger that projects outwardly beyond the free end of the weight in the expandable connecting end expanding position.

17. The doll of claim 13 in which:

the moveable piece may selectively project outwardly beyond either the free end of the weight or the connected end of the weight;

the moveable piece has opposed ends; and an enlarged portion intermediate the opposed ends retains the moveable piece within the weight. except for the selectively projecting end.

18. The doll of claim 13 in which the connector is bifurcated by at least one slot extending inwardly from the expandable connecting end.

19. The doll of claim 1 in which:

the weight includes a moveable ferrous mass; and each hand carries a magnet to which the ferrous mass may be magnetically coupled.

20. The doll of claim 19 in which:

the weight has a connected end and a free end;

the connected end includes an aperture;

each hand contains an aperture that generally aligns with the aperture in the connected end of the weight when the weight is placed on the hand;

the hand is hollow;

the magnet is contained within the hollow hand;

the ferrous mass includes a stem that projects through the aligned apertures of the connected end and the hand into magnetic engagement with the magnet; and there is a space between the ferrous mass and the free end of the weight into which the ferrous mass may drop to release the magnetic engagement.

* * * * *

UNITED STATES PATENT AND TRADEMARK OFFICE

CERTIFICATE OF CORRECTION

PATENT NO. : 5,759,082
DATED : June 16, 1998
INVENTOR(S) : Brian S. Kujawski, Timothy Carroll & Donald A. Rosenwinkel It is certified that error appears in the above-indentified patent and that said Letters Patent is hereby corrected as shown below:

Col. 2, Line 2
delete "band" and insert "hand"

Col. 6, Line 40
after period, delete comma

Signed and Sealed this

Eleventh Day of August 1998

Bruce Lehman

*Attest:*

BRUCE LEHMAN

*Attesting Officer*

*Commissioner of Patents and Trademarks*